US007335270B2

(12) United States Patent
Serizawa et al.

(10) Patent No.: US 7,335,270 B2
(45) Date of Patent: Feb. 26, 2008

(54) GAS GENERATING COMPOSITION AND GAS GENERATOR

(75) Inventors: Kazuya Serizawa, Handa (JP); Katsuhiko Takahashi, Aichi-ken (JP)

(73) Assignee: NOF Corporation, Tokyo (JP)

( * ) Notice: Subject to any disclaimer, the term of this patent is extended or adjusted under 35 U.S.C. 154(b) by 0 days.

(21) Appl. No.: 10/277,846

(22) Filed: Oct. 22, 2002

(65) Prior Publication Data

US 2003/0097953 A1 May 29, 2003

(30) Foreign Application Priority Data

Oct. 23, 2001 (JP) ..... 2001-325538

(51) Int. Cl.
*C06B 29/22* (2006.01)

(52) U.S. Cl. ..... 149/76; 149/19.1; 149/19.7

(58) Field of Classification Search ..... 149/19.7, 149/76, 46

See application file for complete search history.

(56) References Cited

U.S. PATENT DOCUMENTS

| | | | | | |
|---|---|---|---|---|---|
| 3,536,456 | A | * | 10/1970 | Bovard | 422/120 |
| 3,797,854 | A | * | 3/1974 | Poole et al. | 280/741 |
| 3,897,285 | A | * | 7/1975 | Hamilton et al. | 149/41 |
| 3,912,562 | A | * | 10/1975 | Garner | 149/41 |
| 4,179,327 | A | * | 12/1979 | Seldner | 149/3 |
| 4,246,051 | A | * | 1/1981 | Garner et al. | 149/7 |
| 4,416,710 | A | * | 11/1983 | Anderson | 149/19.91 |
| 4,420,931 | A | * | 12/1983 | Anderson | 60/219 |
| 5,320,382 | A | * | 6/1994 | Goldstein et al. | 280/735 |
| 5,382,050 | A | * | 1/1995 | Thompson | 280/741 |
| 5,458,706 | A | * | 10/1995 | Finck et al. | 149/19.2 |
| 5,538,567 | A | * | 7/1996 | Henry et al. | 149/18 |
| 5,610,444 | A | * | 3/1997 | Austruy et al. | 264/3.3 |
| 5,725,699 | A | * | 3/1998 | Hinshaw et al. | 149/19.1 |
| 5,734,123 | A | * | 3/1998 | Wheatley et al. | 149/19.7 |
| 5,792,982 | A | * | 8/1998 | Scheffee | 149/2 |
| 6,235,132 | B1 | * | 5/2001 | Knowlton et al. | 149/36 |
| 6,368,432 | B2 | * | 4/2002 | Serizawa et al. | 149/46 |
| 6,517,647 | B1 | * | 2/2003 | Yamato | 149/45 |
| 6,533,878 | B1 | * | 3/2003 | Fonblanc | 149/76 |
| 6,554,928 | B2 | * | 4/2003 | Astrauskas et al. | 149/19.9 |
| 6,682,616 | B1 | * | 1/2004 | Yamato et al. | 149/45 |
| 6,779,464 | B1 | | 8/2004 | Yamato | |
| 2002/0121321 | A1 | * | 9/2002 | Takayama et al. | 149/46 |

FOREIGN PATENT DOCUMENTS

| | | | | |
|---|---|---|---|---|
| JP | 5-229397 | A | | 9/1993 |
| JP | 8-40178 | | | 2/1996 |
| JP | 8-511233 | A | | 11/1996 |
| JP | 2000-154085 | A | | 6/2000 |
| JP | 2001002488 | | * | 1/2001 |
| WO | 95/26945 | A1 | | 10/1995 |
| WO | WO98/47836 | A2 | | 10/1998 |

OTHER PUBLICATIONS

Miella, "On the Dependence of the Yield Strength of Metals on Temperature and Strain Rate, The Mechanical Equation of the Solid State"; Jul. 2002; AIP Conference Proceedings, vol. 620, iss. No. 1, p. 642-648; downloaded from http://adsabs.harvard.edu/abs/2002AIPC..620..642M.*

* cited by examiner

*Primary Examiner*—Katherine Mitchell
(74) *Attorney, Agent, or Firm*—Crompton, Seager & Tufte, LLC

(57) ABSTRACT

A stable, low-temperature ignition gas generating composition has a heating starting temperature of 170 to 220° C. The gas generating composition includes ammonium perchlorate, a chlorine scavenger, and microcrystalline carbon powder. The chlorine scavenger is sodium nitrate or aluminun/magnesium mixed powder, and the microcrystalline carbon powder is activated carbon or charcoal. The gas generating composition may include 40 to 58% by weight of ammonium perchlorate, 30 to 43% by weight of the chlorine scavenger, and 1 to 30% by weight of the microcrystalline carbon powder.

13 Claims, No Drawings

GAS GENERATING COMPOSITION AND GAS GENERATOR

BACKGROUND OF THE INVENTION

The present invention relates to a gas generator for use in an air bag apparatus for inflating an air bag or a pretensioner for winding up a sheet belt, which saves a driver and a passenger in a vehicle. The present invention also relates to a gas generating composition which is of a low-temperature ignition type, and which is used in a gas generator.

A conventional gas generator for air bag or pretensioner is filled with a gas generating agent comprised mainly of sodium azide and various oxidizing agents. However, sodium azide has high toxicity and poor handling properties, and therefore there are demands for development of a gas generating agent using no sodium azide.

As a first prior art, International Publication No. WO98/47836 discloses a gas generating agent consisting of ammonium perchlorate, a chlorine scavenger, and an organic fuel component. This gas generating agent has low toxicity and excellent long-term stability, and further such excellent stability at high temperatures that the heating starting temperature is 300° C. or higher.

In recent years, for achieving a lightweight gas generator, an aluminum container is used in the gas generator as a substitute for a stainless steel container. The aluminum container has a problem that it has an extremely low strength at high temperatures, as compared to the stainless steel container. Therefore, there is a fear that, when a vehicle is exposed to a high temperature atmosphere due to, for example, fire, the aluminum container cannot endure the combustion pressure caused by combustion of the gas generating agent and bursts. For this reason, it is difficult to use the gas generating agent of the first prior art for filling an aluminum container.

Thus, there are demands for development of a gas generating agent that can be used for filling an aluminum container without any problem. Specifically, there is demanded a gas generating agent that ignites by itself at a temperature lower than the temperature at which the strength of the aluminum container begins to lower, more specifically at a temperature in the range of from 170 to 220° C., so as not to cause the aluminum container to burst.

SUMMARY OF THE INVENTION

An object of the present invention is to provide a gas generating agent that is stable for a long term and has self-ignition properties at 170 to 220° C., and a gas generator incorporating the same.

To achieve the above object, the present invention discloses a gas generating composition which comprises ammonium perchlorate, a chlorine scavenger, and microcrystalline carbon powder.

Further, the present invention discloses a gas generator for air bag and a gas generator for pretensioner, each of which comprises the above gas generating composition, and an aluminum container for accommodating the gas generating composition.

The features of the present invention considered to be novel will be apparent to those skilled in the art particularly from the appended claims. Other aspects and advantages of the present invention will be understood from the following detailed description of the currently preferred embodiments.

DETAILED DESCRIPTION OF THE PREFERRED EMBODIMENTS

The gas generating composition of the present invention contains ammonium perchlorate (a), a chlorine scavenger (b), and microcrystalline carbon powder (c).

For facilitating mixing and combustion, it is preferred that the ammonium perchlorate is in the form of powder. It is preferred that the ammonium perchlorate powder has an average particle diameter in the range of from 1 to 1000 μm. When the average particle diameter of the ammonium perchlorate powder is less than 1 μm, the gas generating composition tends to be difficult to mold. On the other hand, when the average particle diameter of the powder exceeds 1000 μm, the gas generating composition tends to have a low burn rate. For obtaining a gas generating agent molded product having both mechanical properties and combustion performance, the ammonium perchlorate powder more preferably has an average particle diameter in the range of from 5 to 500 μm, still more preferably 10 to 200 μm.

The gas generating composition preferably has an ammonium perchlorate content of 15 to 60% by weight, more preferably 20 to 55% by weight. When the ammonium perchlorate content is less than 15% by weight, the gas generating composition is likely to generate a gas containing a large amount of carbon monoxide. On the other hand, when the ammonium perchlorate content exceeds 60% by weight, the gas generating composition tends to have such a low burn rate that the composition cannot maintain the combustion under a low pressure.

Next, the chlorine scavenger (b) is described below. The chlorine scavenger traps derivatives containing chlorine generated upon burning of ammonium perchlorate to suppress release in the vehicle of the derivatives containing chlorine.

As the chlorine scavenger, an alkali metal nitrate or carbonate can be used, and preferred are lithium nitrate, sodium nitrate, potassium nitrate, lithium carbonate, sodium carbonate and potassium carbonate. Preferred chlorine scavengers also include aluminum powder, magnesium powder, and aluminum/magnesium mixed powder.

For facilitating mixing and combustion, it is desired that the chlorine scavenger is in the form of powder. It is preferred that the chlorine scavenger powder has an average particle diameter in the range of from 1 to 1000 μm. When the average particle diameter of the chlorine scavenger powder is less than 1 μm, the gas generating composition tends to be difficult to mold. On the other hand, when the average particle diameter of the powder exceeds 1000 μm, the gas generating composition tends to have a low burn rate.

If the mechanical properties and combustion performance of the gas generating agent molded product are taken into consideration, the chlorine scavenger more preferably has an average particle diameter in the range of from 5 to 500 μm, still more preferably 10 to 200 μm.

The gas generating composition preferably has a chlorine scavenger content of 10 to 45% by weight, more preferably 15 to 40% by weight.

When the chlorine scavenger content is less than 10% by weight, the gas generating composition is likely to generate a gas containing a large amount of carbon monoxide. On the other hand, when the chlorine scavenger content exceeds 45% by weight, the gas generating composition tends to have such a low burn rate that the composition cannot maintain the combustion under a low pressure.

It is preferred that the sum of the amounts of the ammonium perchlorate and the chlorine scavenger be in the range of from 70 to 99% by weight, with respect to the total weight of the ammonium perchlorate, the chlorine scavenger, and the microcrystalline carbon powder. When the sum of the amounts of the ammonium perchlorate and the chlorine scavenger is less than 70% by weight, the gas generating composition is likely to generate a gas containing a large amount of carbon monoxide. On the other hand, when the sum of the amounts of the ammonium perchlorate and the chlorine scavenger exceeds 99% by weight, the gas generating composition tends to have such a low burn rate that the composition cannot maintain the combustion under a low pressure. For obtaining a gas generating composition having combustion performance and increasing the amount of a gas which contains substantially no carbon monoxide, the sum of the amounts of the ammonium perchlorate and the chlorine scavenger is more preferably in the range of from 80 to 93% by weight, still more preferably 85 to 90% by weight.

Next, the microcrystalline carbon powder (c) is described below.

The microcrystalline carbon powder lowers the heating starting temperature (initial heat-generating temperature) of a mixed ingredient comprised of ammonium perchlorate and the chlorine scavenger so that it ignites by itself at a temperature in the range of from 170 to 220° C., and also serves as a fuel for the mixed ingredient. The microcrystalline carbon powder has the following structure. The two-dimensional structure of the microcrystalline carbon powder resembles a graphite structure such that net planes are arranged in parallel with one another at equal intervals. On the other hand, layer planes are not completely oriented in the direction perpendicular to the layer plane but irregularly stacked on one another, or carbon hexagons are irregularly crossed and connected to one another to form a space lattice, i.e., graphite surface having skew. In other words, the microcrystalline carbon powder is comprised of aggregate of graphite microcrystalline having an uncompleted structure, as compared to the structure of graphite.

Specific examples of microcrystalline carbon powder include activated carbon, charcoal, coke, animal charcoal, bone black and bituminous coal, and these can be used individually or in combination.

Of these, preferred are activated carbon and charcoal which can lower the heating starting temperature of the gas generating composition to 210° C. or less. More preferred is activated carbon which can lower the heating starting temperature to 190° C. or less.

For facilitating mixing and combustion, it is desired that the microcrystalline carbon is in the form of powder. It is preferred that the microcrystalline carbon powder has an average particle diameter in the range of from 0.1 to 500 μm. When the average particle diameter of the microcrystalline carbon powder is less than 0.1 μm, the gas generating composition tends to be difficult to mold. On the other hand, when the average particle diameter of the powder exceeds 500 μm, the gas generating composition tends to have a low burn rate. For obtaining a gas generating agent molded product having both mechanical properties and combustion performance, the carbon powder more preferably has an average particle diameter in the range of from 1 to 100 μm, still more preferably 3 to 50 μm.

It is preferred that the microcrystalline carbon powder has a specific surface area of 5 to 1600 $m^2/g$. When the specific surface area of the microcrystalline carbon powder is less than 5 $m^2/g$, the gas generating composition tends to have a low burn rate. On the other hand, when the specific surface area of the microcrystalline carbon powder exceeds 1600 $m^2/g$, the productivity of the microcrystalline carbon powder is likely to be poor. For obtaining a gas generating agent molded product having both mechanical properties and combustion performance, the microcrystalline carbon powder more preferably has a specific surface area in the range of from 10 to 1500 $m^2/g$, still more preferably 50 to 1300 $m^2/g$.

The gas generating composition preferably has a microcrystalline carbon powder content of 0.4 to 30% by weight, more preferably 4 to 15% by weight. When the microcrystalline carbon powder content is less than 0.4% by weight, the gas generating composition tends to have such a low burn rate that the composition cannot maintain the combustion under a low pressure. On the other hand, when the microcrystalline carbon powder content exceeds 30% by weight, the gas generating composition is likely to generate a gas containing a large amount of carbon monoxide.

It is preferred that the amount of the microcrystalline carbon powder incorporated is in the range of from 1 to 30% by weight, with respect to the total weight of the ammonium perchlorate, the chlorine scavenger, and the microcrystalline carbon powder. When the amount of the microcrystalline carbon powder is less than 1% by weight, the gas generating composition tends to have such a low burn rate that the composition cannot maintain the combustion under a low pressure. On the other hand, when the amount of the microcrystalline carbon powder exceeds 30% by weight, the gas generating composition is likely to generate a gas containing a large amount of carbon monoxide.

If the combustion performance, the amount of a gas formed and the fact that the gas contains substantially no carbon monoxide are taken into consideration, the amount of the microcrystalline carbon powder incorporated is more preferably in the range of from 7 to 20% by weight, still more preferably 10 to 15% by weight.

As one preferred example of the gas generating composition, there can be mentioned a gas generating composition which comprises: 40 to 58% by weight, preferably 45 to 55% by weight of ammonium perchlorate; 30 to 43% by weight, preferably 33 to 38% by weight of sodium nitrate or aluminum/magnesium mixed powder as the chlorine scavenger; and 1 to 30% by weight, preferably 10 to 20% by weight of activated carbon or charcoal as the microcrystalline carbon powder.

Next, carbon monoxide generated from the gas generating composition is described below.

Basically, it is not preferred that the gas generated from the gas generating composition contains harmful carbon monoxide. The reason is that, when a large amount of harmful carbon monoxide is generated upon actuating a gas generator for air bag or a gas generator for pretensioner and fills a vehicle, a driver and a passenger suffer a serious damage. Therefore, it is preferred that the gas generating composition has an oxygen balance of zero so as not to generate carbon monoxide.

It should be noted that, as disclosed in Japanese Unexamined Patent Publication No. Hei 8-40178, when using an apparatus which keeps oxygen in a gas generator under pressure, there is no problem even when the gas generated from the gas generating composition contains carbon monoxide. The reason is that carbon monoxide formed is oxidized by oxygen and then the resultant carbon dioxide is emitted in the vehicle.

Next, the polymer binder (d) is described below. The polymer binder functions not only as a binder for shaping the ammonium perchlorate, chlorine scavenger, and microcrystalline carbon powder together into grains, pellets, or granules but also as a fuel for them.

The polymer binder specifically includes at least one kind selected from the group consisting of cellulose-based polymers such as nitrocellulose, cellulose acetate, carboxymethyl cellulose and its salt, carboxymethylethyl cellulose, hydroxymethyl cellulose, hydroxyethyl cellulose, hydroxypropyl cellulose, microcrystalline cellulose, cellulose acetate butyrate, methyl cellulose, ethyl cellulose, cellulose acetate nitrate and cellulose nitrate carboxymethyl ether; polyvinyl-based polymers such as polyvinyl alcohol, polyvinyl butyral, polyvinyl ether, polyvinyl acetal, polyvinyl formal, polyvinyl pyrrolidone, polyvinyl caprolactam, a copolymer of polyvinyl pyrrolidone and polyvinyl caprolactam and a carboxyvinyl polymer; polyester-based polymers such as a polyester synthetic fiber, polyethylene terephthalate and an unsaturated polyester resin; polyurethane-based polymers such as a urethane resin; polyether-based polymers such as polypropylene oxide, polyphenylene oxide and polyetherimide; polyacrylic polymers such as polyacrylamide and derivatives thereof, polyacrylhydrazide, sodium polyacrylate, polyacrylic acid derivatives, polyacrylate and polymethacrylate; thermoplastic elastomers such as polyurethane elastomer (e.g., trade name: Pandex, manufactured by Dainippon Ink and Chemicals, Inc.), polyester elastomer (e.g., trade name: Pelprene, manufactured by Toyobo Co., Ltd.) and polystyrene elastomer (e.g., trade name: Craton, manufactured by Shell Japan Ltd.); polyamides such as nylon 6, nylon 66, nylon 610, nylon 612, nylon 11, nylon 12, nylon 46, a copolymerized polyamide, a methoxymethylated polyamide and an alcohol soluble polyamide; energetic compound binders such as a glycidyl azide polymer, 3,3-bis(azidomethyl)oxetane, 3-azidomethyl-3-methyloxetane and 3-nitrate methyl-3-methyloxetane; polysaccharides such as guar gum, soluble starch, pectin, chitin substances and their derivatives; and rubbers such as acrylic rubber, isoprene rubber, urethane rubber, silicone rubber, Viton (Kelf), butadiene rubber, butyl rubber, nitrile-butadiene rubber and fluororubber.

It is preferred that the gas generating composition has a polymer binder content of 20% by weight or less. When the polymer binder content exceeds 20% by weight, the gas generating composition is improved in moldability, but it is likely to generate a gas containing a large amount of carbon monoxide. For achieving moldability of the gas generating composition and generation of a gas which contains substantially no carbon monoxide, the polymer binder content is more preferably in the range of from 1 to 15% by weight, still more preferably 3 to 10% by weight.

Next, an organic acid or a salt thereof (e) is described below.

Component (e) is used for increasing the amount of a gas generated from the gas generating composition and for improving ignitability of the gas generating composition.

Component (e) includes specifically carboxylic acids such as acetylenedicarboxylic acid, acetylenemonocarboxylic acid, citric acid, malonic acid, malic acid, fumaric acid, mucic acid, succinic acid, maleic acid, alloxanic acid, oxalacetic acid, oxalosuccinic acid, hydantoic acid, glutaric acid and ketoglutaric acid; alcohols such as ascorbic acid, saccharides, aldaric acid, aidose, aldonic acid, uronic acid, osazone, osamine, osone, ketose and glycosamine; amino acids such as asparagine, aspartic acid, glycine, arginine, nitro arginine, glutamine, glutamic acid, alanine, isoleucine, threonine and valine; acid amides such as orotic acid, acetylurea, acetylene urea, barbituric acid, malonamide, uric acid, succinic acid amide, succinic anhydride, violuric acid, allantoin, alloxan, alloxantin, hydrazodicarboamide, parabanic acid, glycocyamidine, purpuric acid, hydantoin, uramil, isocyanuric acid, cyamelide, oxamic acid, oxamide, dialuric acid, urazole, pyrazolone, dilituric acid, creatinine and maleic hydrazide; acid imides such as succinic acid imide; metal carbonates such as sodium fumarate, disodium fumarate and potassium acetylenecarboxylate; alcohol metal salts such as sodium ascorbate; metal salts of amino acid such as sodium glutamate; metal salts of acid amide such as sodium urate; ammonium carbonate such as citric acid ammonium; and melamine, guanazole, uracil, cyanuric acid and amyrin, and at least one kind selected from the above compounds is used.

Of these, for improving the ignitability of the gas generating composition, preferred are sodium fumarate, disodium fumarate, succinic acid amide, and glutamic acid each having more excellent heat resistance.

It is preferred that the gas generating composition has a component (e) content of 20% by weight or less. When the component (e) content exceeds 20% by weight, the gas generating composition is improved in ignitability, but it is likely to generate a gas containing a large amount of carbon monoxide.

For improving the ignitability of the gas generating composition and increasing the amount of a gas which contains substantially no carbon monoxide, the component (e) content is more preferably in the range of from 1 to 15% by weight, still more preferably 5 to 10% by weight.

Next, combustion controlling agent (f) is described below.

It is preferred that a combustion controlling agent for controlling the burn rate is added to the gas generating composition. As the combustion controlling agent, a high energy substance and a decomposition catalyst for ammonium perchlorate can be used.

Examples of high energy substances include trimethylenetrinitroamine (RDX), tetramethylenetetranitroamine (HMX), pentaerythritol tetranitrate (PETN), triaminoguanidine nitrate (TAGN), and hydrazine nitrate (HN).

Examples of decomposition catalysts for ammonium perchlorate include metal oxides, such as iron oxides, copper oxides, chromium oxides, cobalt oxides, and aluminum oxides; ferrocene derivatives, such as ferrocene, n-butylferrocene, and catocene; powder of metals, such as magnesium; metal fluorides, such as lithium fluoride; hydrogenated boron; and tetraaza-14-annulene metal complexes.

It is preferred that the combustion controlling agent has an average particle diameter in the range of from 0.1 to 500 μm. When the average particle diameter of the combustion controlling agent is less than 0.1 μm, the gas generating composition tends to be difficult to mold. On the other hand, when the average particle diameter of the combustion controlling agent exceeds 500 μm, the effect of improving the burn rate of the gas generating composition is unlikely to be exhibited. For obtaining a gas generating agent molded product having both mechanical properties and combustion performance, the combustion controlling agent more preferably has an average particle diameter in the range of from 0.5 to 100 μm, still more preferably 1 to 30 μm.

It is preferred that a combustion controlling agent is incorporated in an amount of 20% by weight or less in the gas generating composition. When the combustion controlling agent content exceeds 20% by weight, the gas generating composition is improved in combustion performance, but it is likely to generate a gas containing a large amount of carbon monoxide.

For achieving handling properties and combustion performance as well as generation of a gas which contains substantially no carbon monoxide, the combustion controlling agent content is more preferably in the range of from 1 to 15% by weight, still more preferably 3 to 10% by weight.

As another preferred example of the gas generating composition, there can be mentioned a gas generating composition which comprises: 40 to 53% by weight, preferably 45 to 50% by weight of ammonium perchlorate; 29 to 38% by weight, preferably 32 to 35% by weight of sodium nitrate or aluminum/magnesium mixed powder as the chlorine scavenger; 5 to 20% by weight, preferably 8 to 15% by weight of activated carbon or charcoal as the microcrystalline carbon powder; and 4 to 15% by weight, preferably 8 to 12% by weight of cellulose acetate butyrate or cellulose acetate as component (d).

For imparting plasticity to the gas generating composition to improve the moldability, a plasticizer can be added. As the plasticizer, any plasticizers can be used as long as they have excellent compatibility with a binder. Examples of plasticizers include phthalic acid diester plasticizers, such as dibutyl phthalate, dimethyl phthalate, and diethyl phthalate; phosphates; fatty acid ester plasticizers, such as triacetin, acetyltriethyl citrate, and acetyltributyl citrate; nitro plasticizers, such as trimethylolethane trinitrate, diethylene glycol dinitrate, triethylene glycol dinitrate, nitroglycerin, and bis-2,2-dinitropropylacetal/formal; and glycidylazide plasticizers.

It is preferred that the amount of the plasticizer added is 10% by weight or less, with respect to the weight of the gas generating composition. When the amount of the plasticizer exceeds 10% by weight, the effect of the plasticizer is remarkable, but the content of the other components is lowered and hence the combustion properties of the composition become poor, so that the gas generating composition is likely to generate a gas containing a large amount of carbon monoxide.

For achieving generation of a gas which contains substantially no carbon monoxide, the amount of the plasticizer is more preferably in the range of from 1 to 5% by weight, still more preferably 1 to 3% by weight.

Further, for improving the combustion properties of the gas generating composition, an additional oxidizing agent other than the ammonium perchlorate and chlorine scavenger can be added.

With respect to the additional oxidizing agent, there is no particular limitation, and any known oxidizing agents can be used. Specific examples include nitrates, nitrites, basic nitrates, and oxohalogenates. Examples of nitrates include alkali metal nitrates, such as potassium nitrate; and alkali earth metal nitrates, such as barium nitrate and strontium nitrate. Examples of nitrites include alkali metal nitrites, such as sodium nitrite and potassium nitrite; and alkali earth metal nitrite, such as barium nitrite and strontium nitrite. Examples of basic metal nitrates include basic manganese nitrate, basic iron nitrate, basic molybdenum nitrate, basic bismuth nitrate, and basic cerium nitrate. Examples of oxohalogenates include halogenates and perhalogenates. Specific examples of halogenates include alkali metal halogenates, such as potassium chlorate and sodium chlorate; and alkali earth metal halogenates, such as barium chlorate and calcium chlorate. Specific examples of perhalogenates include alkali metal perhalogenates, such as potassium perchlorate and sodium perchlorate; and alkali earth metal perhalogenates, such as barium perchlorate and calcium perchlorate.

For facilitating mixing and combustion, it is desired that the additional oxidizing agent is in the form of powder. It is preferred that the oxidizing agent powder has an average particle diameter in the range of from 1 to 1000 μm. When the average particle diameter of the oxidizing agent powder is less than 1 μm, production of the oxidizing agent powder tends to be difficult. On the other hand, when the average particle diameter of the oxidizing agent powder exceeds 1000 μm, it is difficult to intimately mix the oxidizing agent powder with a binder, and thus the gas generating agent molded product tends to have poor mechanical properties to lower the burn rate.

For obtaining a gas generating agent molded product having both mechanical properties and combustion performance, the additional oxidizing agent powder more preferably has an average particle diameter in the range of from 5 to 500 μm, still more preferably 10 to 200 μm.

It is preferred that the amount of the additional oxidizing agent incorporated is 20% by weight or less, with respect to the weight of the gas generating composition. When the amount of the additional oxidizing agent exceeds 20% by weight, the effect of improving the burn rate is remarkable, but the amount of a gas generated is considerably reduced, so that a residue is likely to remain in a large amount after combustion.

For improving the combustion performance of the gas generating composition and suppressing considerable lowering in the amount of the gas generated, the amount of the additional oxidizing agent incorporated is more preferably in the range of from 1 to 15% by weight, still more preferably 3 to 10% by weight.

For improving the aging stability of the gas generating agent, an aging stabilizer can be added. As the aging stabilizer, any stabilizers can be used as long as they can improve the aging stability. Specific examples include diphenylurea derivatives, such as diphenylurea, methyldiphenylurea, ethyldiphenylurea, diethyldiphenylurea, dimethyldiphenylurea, and methylethyldiphenylurea; diphenylamine derivatives, such as diphenylamine and 2-nitrodiphenylamine; phenylurethane derivatives, such as ethylphenylurethane and methylphenylurethane; diphenylurethane derivatives, such as diphenylurethane; and resorcinol. Particularly for obtaining aging stability and ignitability at the initial combustion stage of the gas generating composition, more preferred are diphenylamine and diethyldiphenylurea.

It is preferred that the amount of the aging stabilizer incorporated is 10% by weight or less, with respect to the weight of the gas generating composition. When the amount of the aging stabilizer exceeds 10% by weight, the effect of the stabilizer is remarkable, but the content of the other components is lowered and hence the combustion properties of the gas generating composition become poor, so that the gas generating composition is likely to generate a gas containing a large amount of carbon monoxide.

For improving the aging stability of the gas generating composition and achieving generation of a gas which contains substantially no carbon monoxide, the amount of the aging stabilizer incorporated is more preferably in the range of from 0.1 to 5% by weight, still more preferably 0.5 to 3% by weight.

Next, the form of the gas generating agent molded product in the present invention and a method for producing the same are described below.

The gas generating agent molded product in the present invention may be in any form of grains, pellets, and granules.

Grains or pellets may be specifically in the form of cylinder, single-hole cylinder, 7-hole cylinder, 7-hole hexagonal prism, 7-hole irregular-shape prism, 19-hole cylinder, 19-hole hexagonal prism, 19-hole irregular-shape prism, or tablet.

When the gas generating composition of the present invention is molded into grains by an extrusion method, first, ammonium perchlorate, a chlorine scavenger, microcrystalline carbon powder, a polymer binder, and, if desired, an additive {for example, component (e), component (f), a plasticizer, an additional oxidizing agent, and/or an aging stabilizer} are weighed. The ingredients and water or an organic solvent are placed in a mixer and intimately mixed together to prepare a uniform mixture. The mixture is charged into an extruder, and extruded through a die under a predetermined pressure to produce gas generating agent molded products having a predetermined form and a predetermined size.

When the gas generating composition of the present invention is molded into pellets by a compression molding method, first, ammonium perchlorate, a chlorine scavenger, microcrystalline carbon powder, and water or an organic solvent are placed in a mixer and intimately mixed together to prepare a uniform mixture. The mixture is subjected to granulation and dried, and, if desired, an additive {for example, component (d), component (e), component (f), a plasticizer, an additional oxidizing agent, and/or an aging stabilizer} is added in a predetermined amount to the mixture and mixed by means of a blender (for example, a twin-cylinder mixer) to prepare a uniform mixture. The mixture is charged into a tablet machine to produce gas generating agent molded products having a predetermined form and a predetermined size.

When the gas generating composition of the present invention is molded into granules by granulation, first, ammonium perchlorate, a chlorine scavenger, microcrystalline carbon powder, water or an organic solvent, and, if desired, an additive {for example, component (d), component (e), component (f), a plasticizer, an additional oxidizing agent, and/or an aging stabilizer} are weighed, and intimately mixed together by means of a mixer to prepare a uniform mixture. The mixture is subjected to granulation and dried to produce gas generating agent molded products having a predetermined form and a predetermined size.

Next, the gas generator for air bag of the present invention is described below.

The gas generator for air bag of the present invention is a gas generator for an air bag made of aluminum accommodating the above-described gas generating composition. The container made of aluminum for air bag comprises a container for accommodating the gas generating composition, an ignition agent for facilitating ignition of the gas generating composition, and an ignition apparatus (squib) for igniting the ignition agent. For achieving weight reduction, it is preferred that the container is made of aluminum.

The gas generator or air bag of the present invention is mounted in, for example, a vehicle. When the vehicle crashes, the crash causes an electrical signal to be recognized to actuate the ignition apparatus, so that the ignition agent ignites. Flame generated from the ignition agent passes through a hole in communication with the combustion chamber filled with the gas generating composition and ignites the gas generating composition, so that the gas generating composition generates a gas comprising nitrogen, carbon dioxide, and water vapor. Solid particles formed together with the gas are captured by filters disposed on the outer periphery of the combustion chamber. The gas which has passed through the filters is introduced into a fold air bag to inflate the air bag.

Next, the gas generator for pretensioner of the present invention is described below.

The gas generator for pretensioner of the present invention is a gas generator for a pretensioner made of aluminum accommodating the above-described gas generating composition.

The gas generator for pretensioner is mounted in, for example, a vehicle. When the vehicle crashes, the crash causes an electrical signal to be recognized to actuate the ignition apparatus, so that the ignition agent ignites. Flame generated from the ignition agent ignites the gas generating composition which fills the same combustion chamber. Flame generated from the ignition agent ignites the gas generating composition which fills the same combustion chamber. The thus generated gas immediately moves a piston in a cylinder. The movement of the piston draws a sheet belt connected to one end of the piston. Alternatively, the gas immediately rotates a belt drawing gear. The rotation of the gear draws a sheet belt connected to the gear.

The gas generating composition of the present invention which is of a low-temperature ignition type has the following advantages.

The gas generating composition of the present invention has excellent long-term stability and self-ignition properties at a temperature as relatively low as 170 to 220° C. Therefore, when the gas generating composition is used in a gas generator for an air bag made of aluminum or a gas generator for a pretensioner made of aluminum, the composition ignites by itself before the strength of the aluminum container is lowered, avoiding a danger that the aluminum container bursts. Thus, the gas generating composition of the present invention contributes to a lightweight gas generator and an improvement of the safety.

The present invention will be described in more detail with reference to the following Examples and Comparative Examples. First, the methods of measurement and examination for gas generating agents are described below.

1. Test of Heating Starting Temperature

Using an apparatus for DSC measurement test (manufactured by Seiko Instruments Inc.; model: DSC220u), a heating starting temperature of a sample of the gas generating composition was measured. Conditions for the measurement are such that the temperature elevation rate is 10° C./minute, and the temperatures ranged from 30 to 500° C.

2. Test of High-Temperature Stability

A sample of the gas generating composition was weighed and placed in a sample bottle. The sample bottle was set in a constant temperature bath adjusted to 107° C. and allowed to stand for 400 hours. The sample bottle was taken out from the bath, and the resultant sample of the gas generating composition was examined in respect of presence of decomposition and weight loss. The long-term stability was evaluated according to the following criteria.

Criteria: A sample exhibiting a weight loss of less than 2% is marked with symbol ◎; a sample exhibiting a weight loss of 2 to less than 5% is marked with symbol ○; and a sample exhibiting a weight loss of more than 5% so that it cannot satisfy the requirement of the gas generating agent is marked with symbol x.

EXAMPLE 1

A mixture comprising 50.5% by weight of ammonium perchlorate having an average particle diameter of 18 μm, 36.5% by weight of sodium nitrate having an average particle diameter of 44 μm, and 13.0% by weight of activated carbon (specific surface area: about 950 $m^2/g$; average particle diameter: 20 μm) was weighed and charged into a mixer. A predetermined amount of ethanol was added to the mixture in the mixer and uniformly mixed. The resultant mixture was subjected to granulation and dried to prepare a sample of the gas generating composition.

For confirming the self-ignition properties, test of heating starting temperature was conducted with respect to the sample. Further, the sample was press-molded by means of a rotary tablet machine to obtain a tablet having a diameter of 4.5 mm and a thickness of 1.5 mm. For determining the long-term stability, the high-temperature stability test was conducted with respect to the tablet. The results are shown in Table 1.

EXAMPLES 2 TO 7

Samples of gas generating compositions of Examples 2 to 7 having the respective formulations shown in Table 1 were individually prepared in the same manner as in Example 1. The characteristics of each sample were tested in the same manner as in Example 1. The results are shown in Table 1.

EXAMPLE 8

A raw material mixture comprising 46.5% by weight of ammonium perchlorate having an average particle diameter of 18 μm, 33.5% by weight of sodium nitrate having an average particle diameter of 44 μm, 10.0% by weight of activated carbon (specific surface area: about 950 $m^2/g$; average particle diameter: 20 μm), and 10.0% by weight of cellulose acetate butyrate was prepared. 50% by weight of acetone was added to the raw material mixture and the resulting mixture was uniformly mixed by a Werner-type kneader to prepare a sample in Example 8.

Then, the sample was charged into an extruder having a 6.4 mm die and 0.6 mm pins. The sample was extruded through the die and molded into a 7-hole cylinder form. Then, the molded article was cut into a length of 4.0 mm and dried to obtain grains in a 7-hole cylinder form.

The characteristics of the sample were evaluated in the same manner as in Example 1. The results of evaluation are shown in Table 1.

COMPARATIVE EXAMPLES 1 TO 4

Samples of gas generating compositions of Comparative Examples 1 to 4 having the respective formulations shown in Table 1 were individually prepared in the same manner as in Example 1, and the characteristics of each sample were tested. The results are shown in Table 1.

COMPARATIVE EXAMPLE 5

A sample of a gas generating composition of Comparative Example 5 having the formulation shown in Table 1 was prepared in the same manner as in Example 8, and the characteristics of the sample were tested. The results are shown in Table 1.

From the results shown in Table 1, the following were found out.

The composition of Comparative Example 5 comprised mainly of nitrocellulose exhibited a heating starting temperature of 185° C., and therefore it has a function as a gas generating composition which is of a low-temperature ignition type. However, as a result of the examination of high-temperature stability for determining the long-term stability, it was found that the composition exhibited a weight loss of 5% or more. Thus, the composition cannot be used as a gas generating composition which is of a low-temperature ignition type.

The composition of Comparative Example 1, which comprises ammonium perchlorate and sodium nitrate, has no problem of the long-term stability. The composition of Comparative Example 2, which is obtained by incorporating graphite into the composition of Comparative Example 1, the composition of Comparative Example 3, which is obtained by incorporating carbon black into the composition of Comparative Example 1, and the composition of Comparative Example 4, which is obtained by incorporating iron oxide into the composition of Comparative Example 1, individually have no problem of the long-term stability. However, the compositions of Comparative Examples 1 to 4 individually exhibited a heating starting temperature as high as 250° C. or more, and thus, they cannot be used as a gas generating composition which is of a low-temperature ignition type.

By contrast, the composition of Example 1, which comprises ammonium perchlorate, sodium nitrate, and 13% by weight of activated carbon (microcrystalline carbon powder), exhibited a heating starting temperature of 200° C. or lower. Further, with respect to the long-term stability, the composition satisfactorily met the requirement.

The composition of Example 2 having a microcrystalline carbon powder content of 2% by weight and the composition of Example 3 having a microcrystalline carbon powder content of 25% by weight individually exhibited a heating starting temperature of 200° C. or lower and satisfactorily met the requirement with respect to the long-term stability.

The composition of Example 4, which comprises ammonium perchlorate, sodium nitrate, and 13% by weight of charcoal (microcrystalline carbon powder), exhibited a heating starting temperature of 208° C., and further had no problem of the long-term stability.

It was found that a gas generating composition (Example 5) obtained by incorporating 10.0% by weight of sodium fumarate into the gas generating composition comprising ammonium perchlorate, sodium nitrate, and activated carbon, a gas generating composition (Example 6) obtained by incorporating 10.0% by weight of ascorbic acid into the gas generating composition comprising ammonium perchlorate, sodium nitrate, and activated carbon, a gas generating composition (Example 7) obtained by incorporating 10.0% by weight of copper oxide into the gas generating composition comprising ammonium perchlorate, sodium nitrate, and activated carbon, and a gas generating composition (Example 8) obtained by incorporating 10.0% by weight of cellulose acetate butyrate into the gas generating composition comprising ammonium perchlorate, sodium nitrate, and activated carbon individually exhibited a heating starting temperature of 215° C. or lower, and satisfactorily met the requirement with respect to the long-term stability.

The embodiments of the present invention have been described, but the scope of the present invention is not limited to the above descriptions, and the embodiments may be modified within the scope and equivalence of the appended claims.

TABLE 1

| | Ingredient | Mixing ratio (wt %) | Heating starting temperature (° C.) | High-temperature stability |
|---|---|---|---|---|
| Exp. 1 | (a) ammonium perchlorate | 50.5 | 185 | ◎ |
| | (b) sodium nitrate | 36.5 | | |
| | (c) activated carbon | 13.0 | | |
| Exp. 2 | (a) ammonium perchlorate | 56.9 | 200 | ◎ |
| | (b) sodium nitrate | 41.1 | | |
| | (c) activated carbon | 2.0 | | |
| Exp. 3 | (a) ammonium perchlorate | 43.6 | 183 | ○ |
| | (b) sodium nitrate | 31.4 | | |
| | (c) activated carbon | 25.0 | | |
| Exp. 4 | (a) ammonium perchlorate | 50.5 | 208 | ◎ |
| | (b) sodium nitrate | 36.5 | | |
| | (c) charcoal | 13.0 | | |
| Exp. 5 | (a) ammonium perchlorate | 46.5 | 215 | ◎ |
| | (b) sodium nitrate | 33.5 | | |
| | (c) activated carbon | 10.0 | | |
| | (e) sodium fumarate | 10.0 | | |
| Exp. 6 | (a) ammonium perchlorate | 46.5 | 212 | ○ |
| | (b) sodium nitrate | 33.5 | | |
| | (c) activated carbon | 10.0 | | |
| | (e) ascorbic acid | 10.0 | | |
| Exp. 7 | (a) ammonium perchlorate | 46.5 | 210 | ◎ |
| | (b) sodium nitrate | 33.5 | | |
| | (c) activated carbon | 10.0 | | |
| | (f) copper oxide | 10.0 | | |
| Exp. 8 | (a) ammonium perchlorate | 46.5 | 205 | ◎ |
| | (b) sodium nitrate | 33.5 | | |
| | (c) activated carbon | 10.0 | | |
| | (d) cellulose acetate butyrate | 10.0 | | |
| Comp. Exp 1 | (a) ammonium perchlorate | 58.1 | 310 | ◎ |
| | (b) sodium nitrate | 41.9 | | |
| Comp. Exp 2 | (a) ammonium perchlorate | 50.5 | 292 | ◎ |
| | (b) sodium nitrate | 36.5 | | |
| | (c) graphite | 13.0 | | |
| Comp. Exp 3 | (a) ammonium perchlorate | 50.5 | 252 | ◎ |
| | (b) sodium nitrate | 36.5 | | |
| | (c) carbon black | 13.0 | | |
| Comp. Exp 4 | (a) ammonium perchlorate | 50.5 | 300 | ◎ |
| | (b) sodium nitrate | 36.5 | | |
| | (f) iron oxide | 13.0 | | |
| Comp. Exp 5 | (d) nitrocellulose | 98.0 | 185 | X |
| | (f) diphenylamine | 1.0 | | |
| | (f) dibuthylphthalate | 1.0 | | |

The invention claimed is:

1. A gas generating composition generating a gas containing nitrogen gas, carbon dioxide gas and water vapor when burned and adapted to use with an aluminum container for accommodating the gas generating composition, the gas generating composition comprising:

(a) ammonium perchlorate which generates a chlorine-containing chemical species when burned, where the ammonium perchlorate is present at a weight percent greater than any other component;

(b) a chlorine scavenger for trapping the chlorine-containing chemical species; and (c) a microcrystalline carbon powder fuel having a specific surface area in the range of 50 to 1300 $m^2/g$ and compounded at an amount adapted to lower self-ignition temperature of the gas generating composition, the microcrystalline carbon powder fuel being selected from the group consisting of activated carbon or charcoal.

2. The gas generating composition according to claim 1, wherein the chlorine scavenger includes at least one selected from the group consisting of alkali metal nitrate, alkali metal carbonate, aluminum powder, and magnesium powder.

3. The gas generating composition according to claim 1, wherein the sum of the amounts of the ammonium perchlorate and the chlorine scavenger is 70 to 99% by weight, and the amount of the microcrystalline carbon powder fuel is 1 to 30% by weight, in the gas generating composition.

4. The gas generating composition according to claim 1, wherein the chlorine scavenger is one of sodium nitrate and aluminum/magnesium mixed powder, and wherein the content of the ammonium perchlorate is 40 to 58% by weight, and the content of the chlorine scavenger is 30 to 43% by weight, and the content of the microcrystalline carbon powder fuel is 1 to 30% by weight, in the gas generating composition.

5. The gas generating composition according to claim 1, further comprising at least one additive selected from the group consisting of (d) a polymer binder, (e) an organic acid or a salt thereof, and (f) a combustion controlling agent.

6. The gas generating composition according to claim 5, wherein the additive is the combustion controlling agent and the combustion controlling agent is one of a high energy substance selected from the group consisting of trimethylenetrinitroamine, tetramethylenetetranitroamine, pentaerythritol tetranitrate, triaminoguanidine nitrate, and hydrazine nitrate and a decomposition catalyst for ammonium perchlorate.

7. The gas generating composition according to claim 5, wherein the chlorine scavenger is one of sodium nitrate and aluminum/magnesium mixed powder, the additive is the polymer binder, and the polymer binder is one of cellulose acetate butyrate and cellulose acetate, and wherein the content of the ammonium perchlorate is 40 to 53% by weight, the content of the chlorine scavenger is 29 to 38% by weight, the content of the microcrystalline carbon powder fuel is 5 to 20% by weight, and the content of the polymer binder is 4 to 15% by weight, in the gas generating composition.

8. The gas generating composition according to claim 1, wherein the amount of the microcrystalline carbon powder fuel is 7 to 20% by weight and the sum of the amounts of the ammonium perchlorate and the chlorine scavenger is 80 to 93% by weight with respect to total weight of ammonium perchlorate, the chlorine scavenger, and the microcrystalline carbon powder fuel.

9. The gas generating composition according to claim 1, wherein the gas generating composition is a low-temperature ignition type and the microcrystalline carbon powder fuel lowers the self-ignition temperature of the gas generating composition to a range of 170 to 220° C.

10. A gas generator for air bag, comprising:

a gas generating composition generating a gas containing nitrogen gas, carbon dioxide gas, and water vapor when burned, wherein the gas generating composition contains (a) ammonium perchlorate present in a weight percent greater than any other component, which generates a chlorine-containing chemical species when burned, (b) a chlorine scavenger for trapping the chlorine-containing chemical species, and (c) a microcrystalline carbon powder fuel having a specific surface area in the range of 50 to 1300 $m^2/g$ and compounded at an amount adapted to lower self-ignition temperature of the gas generating composition, the microcrystalline carbon powder fuel being selected from the group consisting of activated carbon and charcoal; and a container made of aluminum for accommodating the gas generating composition.

11. The gas generator according to claim 10, wherein the gas generating composition exhibits high-temperature stability characterized by a weight loss of 5% or less, when assessed by weighing a sample of the gas generating composition, setting the sample in a bottle in a constant temperature bath adjusted to 107° C., allowing it to stand for 400 hours, taking the sample out from the bath, and weighing the resultant sample for the presence of decomposition and weight loss.

12. A gas generator for pretensioner, comprising:

a gas generating composition generating a gas containing nitrogen gas, carbon dioxide gas, and water vapor when burned, wherein the gas generating composition contains (a) ammonium perchlorate present in a weight percent greater than any other component, which generates a chlorine-containing chemical species when burned, (b) a chlorine scavenger for trapping the chlorine-containing chemical species, and (c) a microcrystalline carbon powder fuel having a specific surface area in the range of 50 to 1300 $m^2/g$ and compounded at an amount adapted to lower self-ignition temperature of the gas generating composition, the microcrystalline carbon powder fuel being selected from the group consisting of activated carbon and charcoal; and a container made of aluminum for accommodating the gas generating composition.

13. The gas generator according to claim 12, wherein the gas generating composition exhibits high-temperature stability characterized by a weight loss of 5% or less, when assessed by weighing a sample of the gas generating composition, setting the sample in a bottle in a constant temperature bath adjusted to 107° C., allowing it to stand for 400 hours, taking the sample out from the bath, and weighing the resultant sample for the presence of decomposition and weight loss.

* * * * *

UNITED STATES PATENT AND TRADEMARK OFFICE

CERTIFICATE OF CORRECTION

PATENT NO. : 7,335,270 B2
APPLICATION NO. : 10/277846
DATED : February 26, 2008
INVENTOR(S) : Kazuya Serizawa et al.

It is certified that error appears in the above-identified patent and that said Letters Patent is hereby corrected as shown below:

Abstract
Lines 5-6, delete “aluminun/magnesium”, and insert therefor -- aluminum/magnesium --.

Column 9
Line 57, delete “generator or air”, and insert therefor -- generator for air --.

Signed and Sealed this

Twenty-fourth Day of June, 2008

JON W. DUDAS
*Director of the United States Patent and Trademark Office*